US006058692A

United States Patent [19]

Sand

[11] Patent Number: 6,058,692

[45] Date of Patent: May 9, 2000

[54] PIVOTALLY SEGMENTED DEVICE FOR FEEDING A SET OF WIRES TO A ROBOT ARM

[75] Inventor: Kjell Sand, Västra Frölunda, Sweden

[73] Assignee: Aplicator System AB, Molnlycke, Sweden

[21] Appl. No.: 09/000,420

[22] PCT Filed: Aug. 4, 1995

[86] PCT No.: PCT/SE95/00905

§ 371 Date: Feb. 3, 1998

§ 102(e) Date: Feb. 3, 1998

[87] PCT Pub. No.: WO97/06088

PCT Pub. Date: Feb. 20, 1997

[51] Int. Cl.[7] ..... B65H 57/00

[52] U.S. Cl. ..... 57/352; 57/357; 57/358; 57/361; 242/157 R

[58] Field of Search ..... 242/157 R, 157.1, 242/153, 615.3; 57/293, 294, 352, 357, 354, 358, 359, 361

[56] References Cited

U.S. PATENT DOCUMENTS

| | | | |
|---|---|---|---|
| 2,640,664 | 6/1953 | Porter | 242/157 |
| 2,967,390 | 1/1961 | McCormick | 57/11 |
| 3,133,402 | 5/1964 | Zwolinski et al. | 57/293 |
| 4,322,041 | 3/1982 | Schuller et al. | 242/42 |
| 4,411,130 | 10/1983 | Dubois et al. | 57/352 |
| 4,528,810 | 7/1985 | Vogelsberg | 57/293 |
| 4,586,327 | 5/1986 | Oestreich | 57/6 |
| 5,626,010 | 5/1997 | Loczenski | 57/352 |
| 5,692,368 | 12/1997 | Loczenskj | 57/352 |
| 5,699,660 | 12/1997 | Buluschek | 57/293 |
| 5,746,389 | 5/1998 | Willmann | 242/615.1 |

*Primary Examiner*—William Stryjewski

*Attorney, Agent, or Firm*—Ostrolenk, Faber, Gerb & Soffen, LLP

[57] ABSTRACT

An apparatus for feeding a set of threads (25) to a feeding head at a robot arm (10) which is freely movable in the room. The apparatus comprises a first arm segment (11) which protrudes at an angle from the robot arm (10), and which is pivotally connected with an inner end to the robot arm and constitutes a carrier for a first set of thread guide loops (13). The apparatus also comprises a second arm segment (16) which is pivotally connected to a pivot point (15) at the outer end of the first arm segment (11) and which second arm segment forms a carrier for a second set of thread guide loops (13).

5 Claims, 1 Drawing Sheet

PIVOTALLY SEGMENTED DEVICE FOR FEEDING A SET OF WIRES TO A ROBOT ARM

FIELD OF THE INVENTION

The present invention refers to an apparatus for feeding a set of threads to a feeding head at a robot arm which is freely movable in the room.

BACKGROUND OF THE INVENTION

The production of fibre reinforced thermosetting plastic products can be automatized by the use of an industrial robot, by means of which a fibre feed apparatus can be controlled, so that precise amounts of fibres are fed out which are oriented for maximum strength, without the fibres projecting out through the outer plastic layer of the product. Owing to the repeatability of the robot, the quality of these products can be increased considerably, while at the same time problems related to bad work environment and labour fatigue can be solved.

The fibre feeding apparatus is preferably located in a feedout head which can be mounted upon a movable robot arm. Several fibre threads are supplied to the feedout head, which cuts the threads in suitable lengths. The feeding speed of each fibre thread can be in the range of about 10 meters per second.

Because of the mobility of the robot arm over a comparatively large range of movement, the thin threads of which one or more may have their feeding stopped, risk rubbing against each other and getting tangled.

THE TECHNICAL PROBLEM

One object of the present invention is therefore to provide an apparatus which makes it possible for the robot arm to work freely, without risk for the threads getting tangled.

THE SOLUTION

For this object, the invention is characterized in a first arm segment which protrudes at an angle from the robot arm, and which is pivotally connected with an inner end to the robot arm and constitutes a carrier for a first set of thread guide loops, and in a second arm segment which is pivotally connected to a pivot point at the outer end of the first arm segment and which second arm segment forms a carrier for a second set of thread guide loops. Because of this arrangement of arm segments and thread guide loops, an efficient separation of the single threads is provided with simple means.

DESCRIPTION OF THE DRAWINGS

The invention will be described hereinafter with reference to embodiments that are shown in the enclosed drawings, wherein.

DESCRIPTION OF EMBODIMENTS

Figure 1:
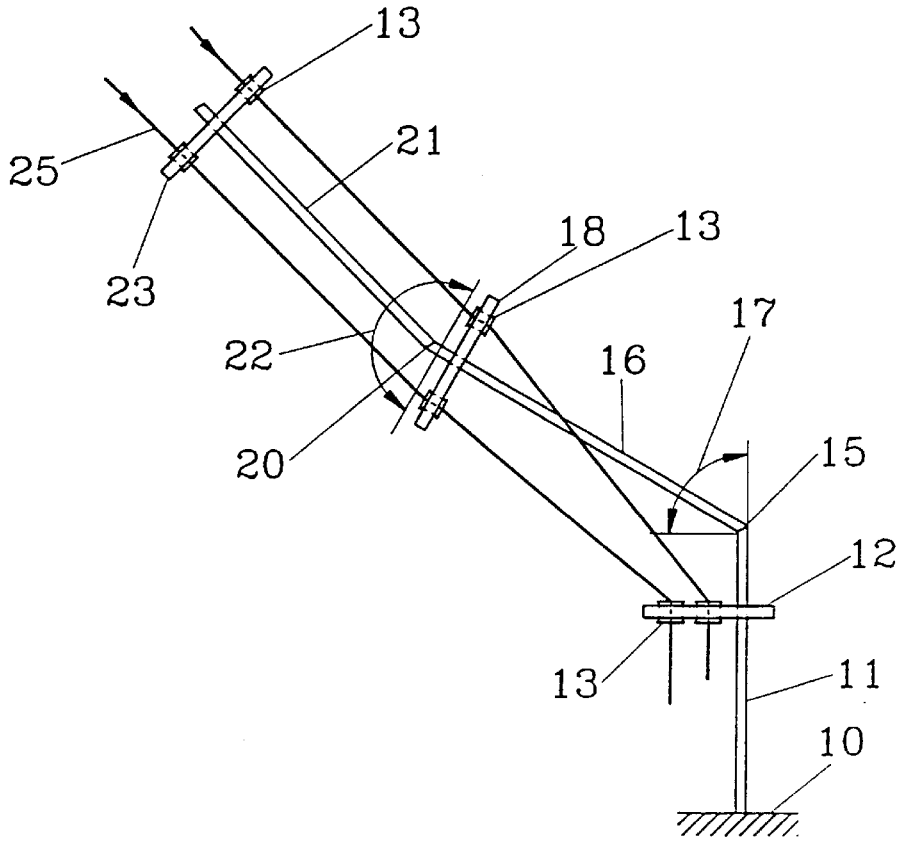
FIG. 1 shows an apparatus according to the invention in a side view.
Figure 2:
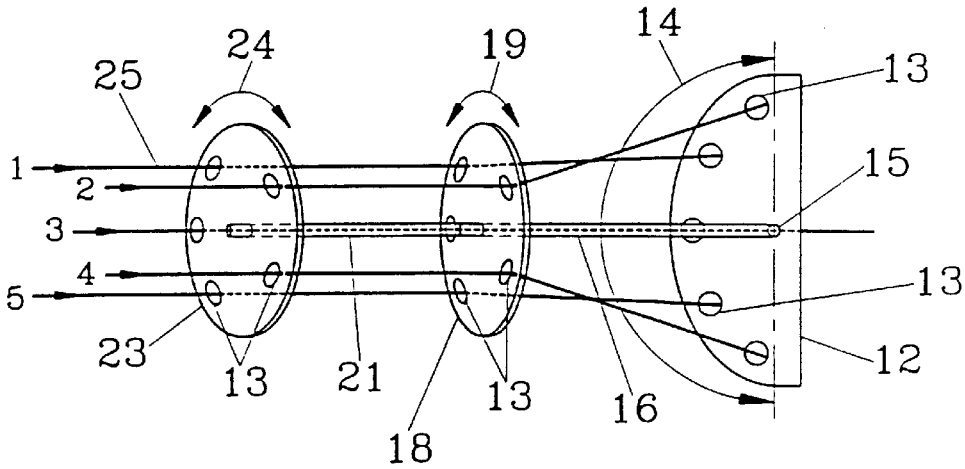
FIG. 2 shows the apparatus in FIG. 1 in a plane view.

In FIG. 1, the reference number 10 designates a robot arm, from which a first arm segment 11 projects. The arm segment 11 is pivotally connected to the robot arm 10 and constitutes an attachment for a carrier 12 with five at distances from each other and the arm segment 11 located thread guide loops 13. The ability to pivot the arm segment 11 is illustrated by the arrow 14 in FIG. 2.

The outer end of the first arm segment 11 is provided with a pivot point 15 in which a second arm segment is pivotally connected. The ability to pivot the arm segment 16 is illustrated by the arrow 17 in FIG. 1. The arm segment 16 forms an attachment for a second carrier 18 which in the same manner as the carrier 12 is provided with five thread guide loops 13. The carrier 18 is rotatable connected to the arm segment 16 which is illustrated by the arrow 19 in FIG. 2.

In a corresponding way, the outer end of the second arm segment 16 is provided with a pivot point 20, in which a third arm segment 21 is pivotally connected. The ability to pivot the arm segment 21 is illustrated by the arrow 22 in FIG. 1. The arm segment 21 forms an attachment for a third carrier 23 which in the same manner as the carriers 12 and 18 is provided with five thread guide loops 13. The carrier 23 is rotatable connected to the arm segment 21 which is illustrated by the arrow 24 in FIG. 2.

Thus, the threads 25 are pulled from different magazine bobbins, the straight way between the thread guide loops 13 in the carriers 23, 18 and 12, without crossing them and at about the same distance from the respective arm segment.

Then when the robot arm moves, the arm segments 11, 16 and 21 will change their relative angles and adjust themselves according to the direction of the magazine bobbins. To this, the bobbins 12, 18 and 23 will automatically turn themselves around the arm segments, so that the shortest possible distance of thread line is accomplished, without having the threads rubbing against each other. The thread guide loops 13 may be produced from a ceramic material.

The invention is not limited to the above described embodiment, instead more variants are conceivable within the scoop of the following claims. For example, it is possible add more arm segments. Also, the arm segments may be flexible of a elastic material.

I claim:

1. An apparatus for feeding a set of threads to a robot arm which is freely movable in a room, the apparatus comprising:

a first arm segment which protrudes at an angle from the robot arm, the first arm segment having a first end which is pivotally connected to the robot arm; the first arm segment having a second end a first set of thread guide loops carried on the first arm segment;

a second arm segment pivotally connected to the second end of the first arm segment; and a second set of thread guide loops carried on the second arm segment.

2. The apparatus according to claim 1, further comprising:

the second arm segment having a respective third end;

a third arm segment pivotally connected to the third end of the second arm segment; and a third set of thread guide loops carried on the third arm segment.

3. The apparatus according to claim 1, further comprising a respective carrier for each of the thread guide loops each guide loop is mounted in the respective carrier on the respective arm segment for the respective guide loop, each of the carriers is rotatable around the respective arm segment on which the carrier is mounted.

4. The apparatus according to claim 1, wherein the second arm segment is pivotable about at least 90° with respect to the first arm segment.

5. The apparatus according to claim 1, wherein the arm segments are made of a flexible, elastic material.

* * * * *